US009121674B2

(12) United States Patent
Wilson

(10) Patent No.: US 9,121,674 B2
(45) Date of Patent: Sep. 1, 2015

(54) ARMOR

(75) Inventor: Edwin Eugene Wilson, Colleyville, TX (US)

(73) Assignee: Milmark Technologies, Inc., Colleyville, TX (US)

( * ) Notice: Subject to any disclaimer, the term of this patent is extended or adjusted under 35 U.S.C. 154(b) by 1846 days.

(21) Appl. No.: 12/465,174

(22) Filed: May 13, 2009

(65) Prior Publication Data

US 2012/0174756 A1 Jul. 12, 2012

(51) Int. Cl.
*F41H 5/04* (2006.01)

(52) U.S. Cl.
CPC ..... *F41H 5/04* (2013.01)

(58) Field of Classification Search
USPC ..... 89/36.01–36.07, 36.17; 109/49.5; 428/911; 2/2.5
See application file for complete search history.

(56) References Cited

U.S. PATENT DOCUMENTS

| | | | | |
|---|---|---|---|---|
| 4,426,429 | A | 1/1984 | Di Russo et al. | 428/654 |
| 4,469,537 | A | 9/1984 | Ashton et al. | 148/440 |
| 4,529,640 | A | 7/1985 | Brown et al. | 428/116 |
| 4,735,731 | A | 4/1988 | Rose et al. | 252/8.51 |
| 4,836,084 | A | 6/1989 | Vogelesang et al. | 89/36.02 |
| 4,868,040 | A | 9/1989 | Hallal et al. | 428/251 |
| 5,221,807 | A | 6/1993 | Vives | 89/36.02 |
| 5,421,087 | A | 6/1995 | Newkirk et al. | 29/897.2 |
| 5,723,807 | A | 3/1998 | Kuhn, II | 89/36.02 |
| 5,964,295 | A | 10/1999 | Brown et al. | 166/308 |
| 6,035,936 | A | 3/2000 | Whalen | 166/308 |
| 6,187,451 | B1 | 2/2001 | Boos | 428/598 |
| 6,216,579 | B1 | 4/2001 | Boos et al. | 89/36.02 |
| 6,232,274 | B1 | 5/2001 | Hughes et al. | 507/240 |
| 6,258,859 | B1 | 7/2001 | Dahayanake et al. | 516/77 |
| 6,327,954 | B1 | 12/2001 | Medlin | 89/36.08 |
| 6,506,710 | B1 | 1/2003 | Hoey et al. | 507/242 |
| 6,881,709 | B2 | 4/2005 | Nelson et al. | 507/203 |
| 7,196,041 | B2 | 3/2007 | Jones et al. | 507/265 |
| 7,225,717 | B2 | 6/2007 | Williams | 89/36.08 |
| 7,383,761 | B2 | 6/2008 | Warren et al. | 89/36.02 |
| 7,424,967 | B2 | 9/2008 | Ervin et al. | 228/193 |

(Continued)

FOREIGN PATENT DOCUMENTS

| | | |
|---|---|---|
| DE | 3122367 | 12/1994 |
| EP | 1 947 414 | 7/2008 |

(Continued)

OTHER PUBLICATIONS

Gooch et al.; "Ballistic Testing of Commercial Aluminum Alloys and Alternate Processing Techniques to Increase the Availability of Aluminum Armor"; 20rd International Symposium on Ballistics; 2007; pp. 981-988.

(Continued)

*Primary Examiner* — Michael David
(74) *Attorney, Agent, or Firm* — Renner, Otto, Boisselle & Sklar, LLP

(57) ABSTRACT

A ballistic armor system adapted to protect against penetration of the armor system by projectiles, including a first armor layer; a second armor layer, in which the second armor layer is mounted in spaced-apart relationship to the first armor layer, the relationship defining a void volume between the first armor layer and the second armor layer; and a fluid disposed in the void volume, in which the fluid includes a viscoelastic surfactant at a concentration sufficient to exhibit pseudosolid elastic behavior. The fluid may be removed from the void volume by use of a suitable breaker.

22 Claims, 7 Drawing Sheets

(56) References Cited

U.S. PATENT DOCUMENTS

| | | | | |
|---|---|---|---|---|
| 7,523,693 | B1 | 4/2009 | Engelhart | 89/36.02 |
| 7,608,314 | B2 * | 10/2009 | Plant | 428/86 |
| 7,770,506 | B2 * | 8/2010 | Johnson et al. | 89/36.09 |
| 8,074,552 | B1 * | 12/2011 | Imholt et al. | 89/36.01 |
| 2002/0004464 | A1 | 1/2002 | Nelson et al. | 507/200 |
| 2004/0094026 | A1 | 5/2004 | Efim et al. | |
| 2005/0257677 | A1 | 11/2005 | Ravid et al. | 89/36.02 |
| 2006/0213360 | A1 | 9/2006 | Ravid et al. | 89/36.01 |
| 2007/0060482 | A1 | 3/2007 | Welton et al. | 507/269 |
| 2007/0107778 | A1 | 5/2007 | Bettin et al. | |
| 2007/0178374 | A1 | 8/2007 | Aizenberg et al. | |
| 2008/0066613 | A1 | 3/2008 | Mills et al. | 89/36.09 |
| 2008/0173167 | A1 | 7/2008 | Mills et al. | 89/36.02 |
| 2008/0200353 | A1 | 8/2008 | Dahayanake et al. | 507/240 |
| 2008/0202744 | A1 | 8/2008 | Crews et al. | 166/246 |
| 2008/0223203 | A1 | 9/2008 | Ravid et al. | 89/36.02 |
| 2008/0223204 | A1 | 9/2008 | Genihovich et al. | 89/36.02 |
| 2008/0269081 | A1 | 10/2008 | Lin et al. | 507/209 |
| 2008/0271888 | A1 | 11/2008 | Huang et al. | 166/279 |
| 2008/0286600 | A1 | 11/2008 | Vecchio et al. | 428/600 |

FOREIGN PATENT DOCUMENTS

| | | |
|---|---|---|
| EP | 2 000 352 | 12/2008 |
| WO | 2007/015231 | 2/2007 |
| WO | 2007/115617 | 10/2007 |
| WO | 2008/105889 | 9/2008 |
| WO | 2008/133735 | 11/2008 |
| WO | 2009/017518 | 2/2009 |

OTHER PUBLICATIONS

Showalter et al.; "Ballistic Performance Testing of Aluminum Alloy 5059-H131 and 5059-H136 for Armor Applications"; Army Research Laboratory; May 2007.

Lim et al.; "Mechanical behavior of sandwich panels with tetrahedral and Kagome truss cores fabricated from wires"; *International Journal of Solids and Structures* 43; 2006; pp. 5228-5246.

Wadley et al.; "Fabrication and structural performance of periodic cellular metal sandwich structure"; *Composites Science and Technology* 63; 2003; pp. 2331-2343.

Shikata et al.; "Viscoelastic behavior of aqueous surfactant micellar solutions"; *Korea-Australia Rheology Journal*; Sep. 2002; vol. 14, No. 3; pp. 129-138.

Kefi et al.; "Expanding Applications for Viscoelastic Surfactants"; *Oilfield Review*; Winter 2004/2005; pp. 10-23.

Hoffman et al.; "The rheological behaviour of different viscoelastic surfactant solutions"; *Tenside Surf. Det.* 31; 1994; pp. 389-400.

Hoffman et al.; "Influence of Ionic Surfactants on the Viscoelastic Properties of Zwitterionic Surfactant Solutions"; *Langmuir*, 1992, 8, pp. 2140-2146.

Cellular Materials International Inc.; "Core Designs"; www.cellularmaterials.com/coredesigns.asp; 2 pages. Printed Apr. 13, 2009.

Sypeck et al.; "Cellular Metal Truss Core Sandwich Structures"; *Advanced Engineering Materials*; 2002, 4, No. 10; pp. 759-764.

Advanced Systems & Concepts; Deputy Under Secretary of Defense; "Two FCT Initiatives Aid Mine Resistant Ambush Protected Vehicle Program"; May 21, 2008; 1 page.

Cellular Materials International Inc.; "Armor Technology"; www.cellularmaterials.com/applications/armor.asp; 2 pages. Printed Apr. 8, 2009.

Placzankis et al.; "Performance Assessment of CARC Coated Aluminum Alloy 5059-H131 Using ASTM B 117 Neutral Salt Fog, GM 9540P, and ASTM D 4541 Pull-Off Adhesion for Three Different Pretreatment Methods"; Department of Defense, Tri-Service Corrosion Conference; 2007; pp. 1-21.

PCT/US2009/043756; PCT International Search Report dated Jan. 21, 2010.

* cited by examiner

ARMOR

TECHNICAL FIELD

The present invention relates to armor, more particularly to ballistic armor for applications such as in military vehicles, boats, ships and aircraft, such as armor panels for such applications.

BACKGROUND

Military vehicles, including wheeled and tracked vehicles, boats, ships and aircraft, generally referred to as military vehicles herein, are subject to attack in forms varying from small arms projectiles, to larger projectiles, to mines, to improvised explosive devices (IEDs) and to roadside bombs detonated from beneath, laterally adjacent or overhead. The forces resulting from such detonations can result in severe damage to both the vehicles and to the human occupants of the vehicles. Other vehicles which require armor protection include, for example, limousines, commercial armored cars and other non-military vehicles used for transporting people or high-value cargo.

Various forms of armor have been developed over the years for the purpose of providing protection to both the vehicles and the occupants. Consideration must be given to the type or types of projectile and energetic force against which the armor must provide protection. Consideration must be given to the effectiveness of the overall armor system in protecting against multiple threats. Consideration must be given to the weight of the overall armor system and to the concomitant loss of maneuverability and speed resulting from the weight. The weight of the armor is often the primary limiting factor, since armor having a thickness effective for full protection may possibly exceed the practical weight limits for the vehicle, in terms of lost speed and maneuverability and increased fuel consumption and similar factors. Finally, consideration must be given to the cost of the overall armor system, which generally increases with weight, thickness, new or exotic materials and/or complexity of the overall system.

In order to meet and provide a range of protection from the variety of threats presented by the myriad forms of projectile and energetic forces that may be comprised in any given attack, various forms of composite armor systems have been developed. These composite armor system generally include a plurality of layers of different materials, the combination of which is intended to provide the needed range of protection.

Nevertheless, new forms of explosive device and projectiles are constantly being developed in the never-ending arms race that has been part of human history for millennia. In addition, improvements in parameters such as armor function, durability and reduced weight are continually sought. Thus, there is a constantly evolving need for ever more practical and new forms of armor to provide protection against these threats.

SUMMARY

The present invention provides a novel and unexpected new form of armor, which can be adapted reversibly as needed to meet different threat levels. The armor system of the present invention provides enhanced protection from penetration by projectiles and enhanced energy absorption to provide improved protection to occupants and payloads for which protection is needed.

In one embodiment, the present invention relates to a ballistic armor system adapted to protect against penetration of the armor system by projectiles, comprising:

a first armor layer;

a second armor layer, wherein the second armor layer is mounted in spaced-apart relationship to the first armor layer, the relationship defining a void volume between the first armor layer and the second armor layer; and a fluid disposed in the void volume, wherein the fluid comprises a viscoelastic surfactant at a concentration sufficient to exhibit pseudosolid elastic behavior.

In another embodiment, the present invention relates to a method for improving protection from projectile impact in a ballistic armor system, comprising:

providing a ballistic armor system, comprising:

a first armor layer;

a second armor layer, wherein the second armor layer is mounted in spaced-apart relationship to the first armor layer, the relationship defining a void volume between the first armor layer and the second armor layer; and adding to the void volume a fluid comprising a viscoelastic surfactant at a concentration sufficient to exhibit pseudosolid elastic behavior. In one embodiment, the fluid substantially fills the void volume, while in other embodiments the fluid does not completely fill the void volume. Thus, in one embodiment the void volume further comprises a volume of air or gas in addition to the fluid. In one such embodiment, the volume of air or gas in the void volume with the fluid is in a range up to about 50% by volume of the void volume. In one such embodiment, the volume of air or gas is dispersed in the fluid directly or enclosed in a bead. In one embodiment, the presence of the air or gas in the void volume provides enhanced protection against projectiles, but allowing the fluid comprising a viscoelastic surfactant to absorb impact force from the incoming projectile before the internal pressure in the void volume increases to a point at which the system ruptures or a pressure relief valve opens.

In one embodiment, the method further includes adding to the fluid a breaker to terminate the pseudosolid elastic behavior and to obtain a substantial decrease in viscosity of the fluid and removing the fluid from the volume.

In one embodiment, the fluid comprising the viscoelastic surfactant provides improved protection against penetration of the armor system by projectiles relative to the system with air or a non-viscous fluid disposed in and substantially filling the void volume.

In one embodiment, the ballistic armor system further includes structural contact points disposed in contact with the first armor layer and the second armor layer adapted to maintain the layers in the spaced apart relationship.

In one embodiment, the ballistic armor system further includes a fluid-tight seal at or near at least of portion of outer edges of the first armor layer and the second armor layer to retain the fluid in the void volume.

In one embodiment, the first armor layer and the second armor layer each comprise properties of hardness, thickness, fracture toughness, impact resistance, tensile strength, corrosion resistance, and weldability, and wherein one or more of the properties are different between the first armor layer and the second armor layer but are complementary in providing protection against penetration of the armor system by projectiles.

In one embodiment, the first armor layer and the second armor layer are in substantially parallel planar spaced-apart relationship.

In one embodiment, the ballistic armor system further includes a frangible structure adapted to release a portion of the fluid from the void volume when internal pressure within the void volume increases to a predetermined level. In one embodiment, the internal pressure increase occurs as a result of impact of a projectile against an outer surface the armor system. In one embodiment, the predetermined level is substantially greater than levels reached as a result of normal environmental temperature or pressure changes.

In accordance with the present invention, use of the fluid comprising the viscoelastic surfactant to fill the void volume provides improved protection against penetration of the armor system by projectiles relative to the system with air or a non-viscous fluid disposed in and substantially filling the void volume.

In accordance with the present invention, the void volume can remain empty (i.e., filled with air only) during times of low or zero threat and, when the threat level is expected to become elevated, the void volume is filled with the fluid comprising the viscoelastic surfactant. Thus, when the threat level is or has returned to low, the void volume can be emptied and, with a decreased weight, the vehicle can be transported more easily and more efficiently. In addition, since the armor layers will provide some level of protection absent the fluid comprising the viscoelastic surfactant, if desired the vehicle including the armor system of the present invention also can operate in moderate threat situations with the void volume empty of the fluid comprising the viscoelastic surfactant.

It has been discovered by the present inventor that, due to its high viscosity, the armor system of the present invention, with the void volume filled with the fluid comprising the viscoelastic surfactant, provides much greater protection against a variety of threats than would the same system either with water only or with nothing in the same void volume, in which the systems under comparison are otherwise the same, i.e., are of the same construction and of the same materials.

Two additional benefits are provided by embodiments the armor system of the present invention. First, in the scenario that the outer armor layer is breached, the fluid comprising the viscoelastic surfactant would absorb a substantial portion of the heat energy, as well as of the kinetic energy, associated with the projectile. This would reduce the adverse effects on the inner armor layer, and possibly reduce the possibility that it would be breached as well. Second, in the worst-case scenario of the armor system being fully breached, the fluid comprising the viscoelastic surfactant would be released into the interior of the vehicle under protection. This release would result in the distribution of the fluid comprising to viscoelastic surfactant, while still in its high-viscosity condition, over most or all of the surfaces of both the interior and the occupants of the vehicle, thereby affording at least some protection from the otherwise devastating effects of the full breach of the armor system. This benefit would not be possible with the same system either with water only or with nothing in the same void volume.

Thus, the present invention provides an innovative and unexpected response to the constantly evolving need for ever more practical and new forms of armor to provide protection against the myriad threats to military vehicles.

Figure 1:
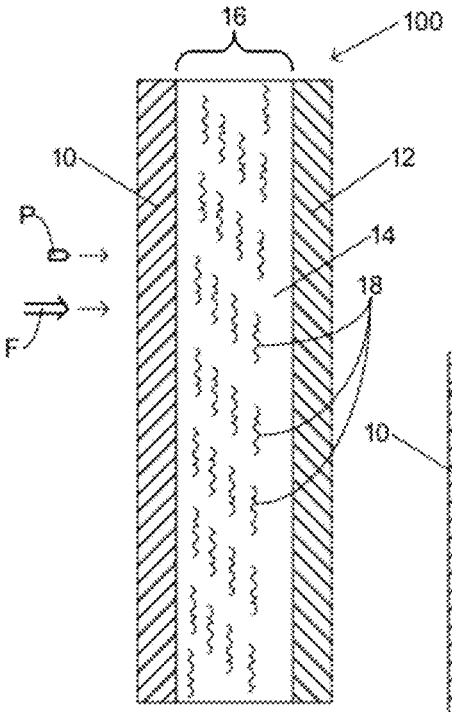
FIG. 1 is a side elevational view of a cross-section of a portion of an armor system in accordance with a basic embodiment of the present invention.

It should be appreciated that for simplicity and clarity of illustration, elements shown in the figures have not necessarily been drawn to scale. For example, the dimensions of some of the elements may be exaggerated relative to each other for clarity. Further, where considered appropriate, reference numerals have been repeated among the Figures to indicate corresponding elements.

Furthermore, it should be appreciated that the process steps and structures described below may not form a complete process flow for producing an armor system. The present invention can be practiced in conjunction with known materials and manufacturing techniques currently used in the art, and only so much of the commonly practiced process steps are included as are necessary for an understanding of the present invention.

DETAILED DESCRIPTION

In describing embodiments of the present invention, various, exemplary arrangements of layers of armor layers and/or auxiliary layers, in relation to a layer of a fluid containing a viscoelastic surfactant are described first, and thereafter the fluid containing a viscoelastic surfactant and the viscoelastic surfactant itself are described. It is contemplated that every combination of the various individual embodiments described in detail herein is within the scope of the invention disclosed herein.

The armor layers described herein may be formed, for example, of any suitable material used for armor applications. Such an armor plate may comprise a ceramic, a glass, a metal-filled composite, a ceramic-filled composite, a glass-filled composite, a cermet, high hardness steel (HHS), armor aluminum alloy, titanium or a combination of any of the foregoing as armor layers.

The armor layers described herein may be used by military personnel to defeat a number of ballistic threats, such as 9 mm full metal jacket (FMJ) bullets and a variety of fragments generated due to explosion of hand-grenades, artillery shells, Improvised Explosive Devices (IED) and other such devices encountered in a military and peace keeping missions. The structures of the present invention are particularly useful for reinforcing objects such as structural members of vehicles, including doors and bulk head structures of automobiles and marine vessels, and may also be useful for protecting large building structures from explosions, and for reinforcing movable ballistic walls, bunkers and other similar structures.

The ballistic resistance properties are determined using standard testing procedures that are well known in the art. Particularly, the protective power or penetration resistance of a structure is normally expressed by citing the impacting velocity at which 50% of the projectiles penetrate the composite while 50% are stopped by the shield, also known as the V50 value. As used herein, the "penetration resistance" of an article is the resistance to penetration by a designated threat, such as physical objects including bullets, fragments, shrapnel and the like, and non-physical objects, such as a blast from explosion.

For composites of equal areal density, which is the weight of the armor panel divided by the surface area, the higher the V50, the better the resistance of the composite.

FIG. 1 is a side elevational view of a cross-section of a portion of an armor system 100 in accordance with an embodiment of the present invention. As shown in FIG. 1, the ballistic armor system includes a first armor layer 10, a second armor layer 12, and a fluid 14 disposed in and (in this embodiment) substantially filling a void volume 16 defined by the first armor layer 10 and the second armor layer 12. As shown in FIG. 1, the second armor layer 12 is mounted in a spaced-apart relationship to the first armor layer 10, and the spaced-apart relationship defines the void volume 16 between the first armor layer 10 and the second armor layer 12. As shown in FIG. 1, in this embodiment, the void volume 16 is completely filled by the fluid 14. In accordance with this embodiment of the invention, the fluid 14 disposed in the void volume 16 includes a viscoelastic surfactant, schematically depicted by the plurality of tubular micelles 18 in FIG. 1. In accordance with the invention, the viscoelastic surfactant is present in the fluid 14 at a concentration sufficient for the fluid to exhibit pseudosolid elastic behavior.

As shown in FIG. 1, it is contemplated that the first armor layer 10 and the second armor layer 12 would generally be mounted in a direction roughly perpendicular to the direction from which a projectile P or an energetic force F would approach the armor system. Of course, the system is intended to protect from projectiles and forces arriving from other than a perpendicular direction, but as will be recognized, the direct, perpendicular approach is likely to be the most destructive and difficult to deal with. Similar considerations apply to the other embodiments described in the following, unless otherwise specifically stated. It is noted that the micelles 18 are referred to as "tubular micelles 18", which is not intended to be limiting, but to refer generally to the elongated, rodlike, wormlike and/or entangled micellular structures described herein for the micelles formed by the viscoelastic surfactant when it is present in a fluid at a concentration sufficient of exhibit pseudosolid behavior.

Figure 2:
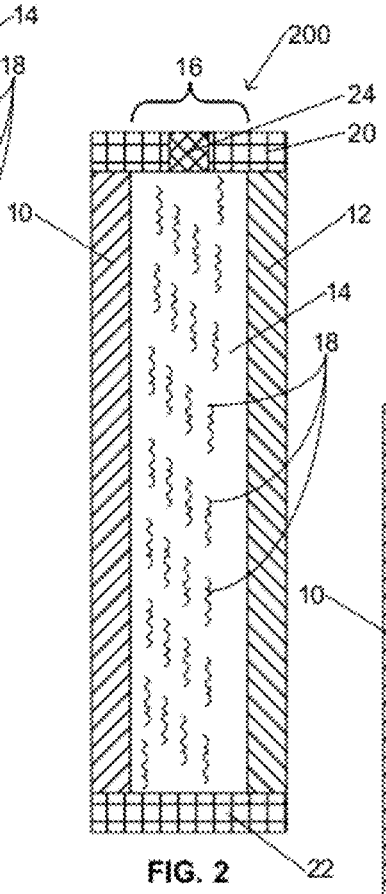
FIG. 2 is a side elevational view of a cross-section of a portion of an armor system in accordance with another embodiment of the present invention.

FIG. 2 is a side elevational view of a cross-section of a portion of an armor system 200 in accordance with another embodiment of the present invention. As shown in FIG. 2, the ballistic armor system includes a first armor layer 10, a second armor layer 12, and a fluid 14 disposed in and substantially filling a void volume 16 defined by the first armor layer 10 and the second armor layer 12. These components, the fluid 18 filling the void volume 16 and the viscoelastic surfactant are the same or substantially the same as shown in FIG. 1. In the embodiment illustrated in FIG. 2, the first armor layer 10 and the second armor layer 12 are attached or connected to each other by a top end panel 20 and a bottom end panel 22. It is noted that the terms "top" and "bottom" are used merely for convenience in referring to these structures, and do not necessarily require that the armor system be oriented in a vertical, "top/bottom" arrangement is depicted in FIG. 2, which so arranged for illustrative, non-limiting purposes.

Thus, in this embodiment, the armor system 200 includes a fluid-tight seal formed by the top end panel 20 and the bottom end panel 22, which are disposed at or near the outer edges of the first armor layer 10 and the second armor layer 12 to retain the fluid 14 in the void volume 16.

In the embodiment shown in FIG. 2, the top end panel 20 includes a plug 24. The plug 24 may function as a pressure relief valve, as a drain valve, or both. As will be described in more detail in the following, in accordance with various embodiments of the present invention, the fluid 14 may be removed from the armor system 200. In such embodiments, the plug 24 may be used as a drain valve. As will be understood, the plug 24 may also be used as a pressure relief valve, when the armor system is impacted by a sufficiently massive and/or energetic projectile or force, the first armor layer 10 may be forced to bend or be otherwise deformed and be caused to move closer to the second armor layer 20, thus resulting in a sudden, large increase in pressure in the fluid 14. Without some pressure relief valve or structure, this sudden increase in pressure could result in catastrophic failure of the armor system. Thus, in one embodiment, the plug 24 functions as a pressure-relief valve. In such an embodiment, the plug 24 is designed to partially yield, rupture or fail at a pre-determined internal pressure in the void volume 16. This pressure can be suitably determined by the skilled person based on the optimal amount of energy that can be absorbed by the fluid 14 prior to either rupture of the plug 24 or a catastrophic failure of the armor system 200. The plug 24 may be suitably designed to release some but not all pressure (i.e., to partially yield), thus allowing the system to retain a portion of the fluid and thereby to continue to function as contemplated herein. It is further noted that the plug is oriented in the aforementioned "top/bottom" direction. This is considered to be the optimum orientation, to avoid weakening either the first armor layer 10 or the second armor layer 12 by creating an opening, and thus a "weak spot" in the primary working surfaces of these layers. Of course, based on various considerations, the plug 24 could be mounted in one or both of the first armor layer 10 and the second armor layer 12.

Figure 3:
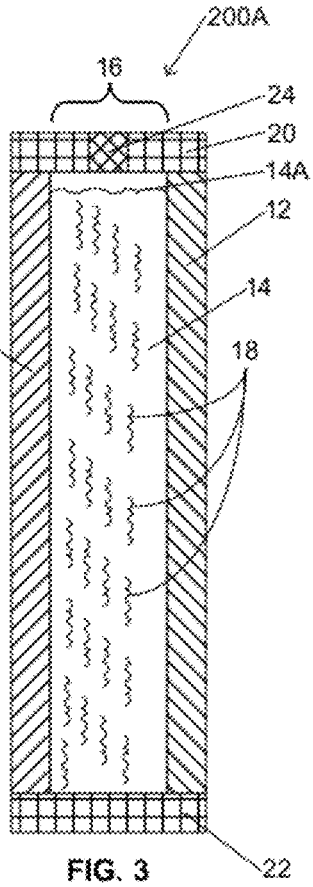
FIG. 3 is a side elevational view of a cross-section of a portion of an armor system in accordance with a further embodiment of the present invention.

FIG. 3 is a side elevational view of a cross-section of a portion of an armor system 200A in accordance with a further embodiment of the present invention. The embodiment illustrated in FIG. 3 is substantially the same as the embodiment illustrated in FIG. 2, except that in FIG. 3, the fluid 14 does not completely fill the void volume 16, as schematically depicted by showing the surface 14A of the fluid 14. As will be recognized, providing a "head space", i.e., a portion of the void volume 16, filled only with, e.g., air or another gas, can provide an energy-absorbing cushion. Thus, in this embodiment, when a projectile or energetic force impacts the armor system, the increase in pressure in the void volume 16 will not be instantaneous, as it would be with an incompressible fluid. While the delay in reaching the maximum pressure might be on the order of milliseconds, this slight delay should allow for some dissipation of the impact energy. In the embodiment illustrated in FIG. 3, the fluid almost or substantially fills the void volume 16, but this is not necessarily the case. Depending on factors such as the exposure area of the armor system to the incoming projectiles or energetic forces, the ratio of fluid to gas in the void volume 16 can be adjusted accordingly. Thus, for example, in some applications, the fluid may fill 95% of the void volume 16, or 90% of the void volume 16, or 80% of the void volume 16, or 50-75% of the void volume 16, etc., as may be determined by the skilled person. Factors to be considered include, for example, the area of the first and second armor layers, the internal volume of the void volume 16, the frangibility and/or releasability of the plug 24, the total force to which the armor system is expected to be exposed, and other related or similar factors known to the skilled person.

Thus, in one embodiment, the fluid substantially fills the void volume, while in other embodiments the fluid does not completely fill the void volume, leaving a head space of air or gas in the void volume. Thus, in one embodiment the void volume further comprises a volume of air or gas in addition to the fluid. In one such embodiment, the volume of air or gas in the void volume with the fluid is in a range up to about 50% by volume of the void volume. In one such embodiment, the volume of air or gas is dispersed in the fluid directly or enclosed in a bead. In one embodiment, the presence of the air or gas in the void volume provides enhanced protection against projectiles, but allowing the fluid comprising a viscoelastic surfactant to absorb impact force from the incoming projectile before the internal pressure in the void volume increases to a point at which the system ruptures or a pressure relief valve opens.

Figure 4:
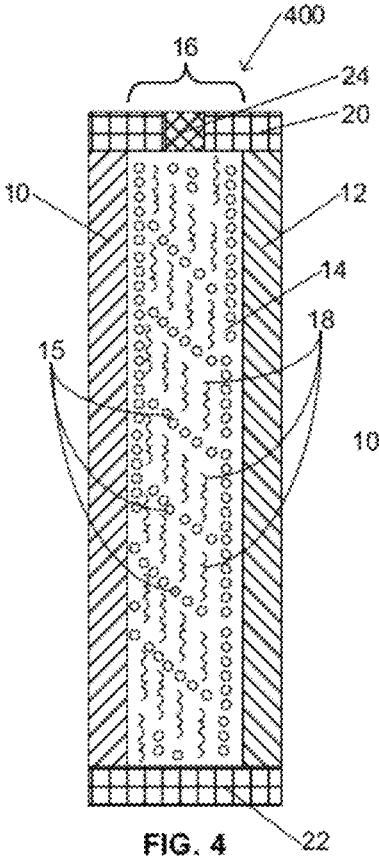
FIG. 4 is a side elevational view of a cross-section of a portion of an armor system in accordance with yet another embodiment of the present invention.

In one embodiment, illustrated schematically in FIG. 4, the fluid containing the viscoelastic surfactant further comprises gas-filled hollow particles, such as balls or other (usually) spherical or substantially spherical hollow particles. These hollow particles can be compressed or crushed by increased pressure in the fluid contained in the void volume upon impact of a projectile against the outer surfaces of the armor system, and thereby absorb additional energy. In this embodiment, some or all of the volume of air or gas in the void volume is contained in the hollow particles. Thus, in this embodiment, the presence of the air or gas in the hollow particles functions in much the same way as described above with respect to the air or gas in the head space of the void volume.

FIG. 4 is a side elevational view of a cross-section of a portion of an armor system 400 in accordance with yet another embodiment of the present invention. Except as described in the following, the embodiment illustrated in FIG. 4 is substantially similar to the embodiments illustrated in FIGS. 2 and 3. In the FIG. 4 embodiment, the armor system 400 includes a substantial portion of the void volume containing a gas illustrated in the form of a plurality of bubbles or gas-filled particles 15. It is noted that the schematic cross-sectional view of FIG. 4 may be considered to illustrate either or both of suspended gas bubbles or suspended air- or gas-filled particles or balls 15. It is noted that the illustration of FIG. 4 is highly schematic and that no particular significance is to the attributed to the positions of the particles 15 or to the tubular micelles 18, which are arrayed only to emphasize that there are many of them present.

Figure 5:
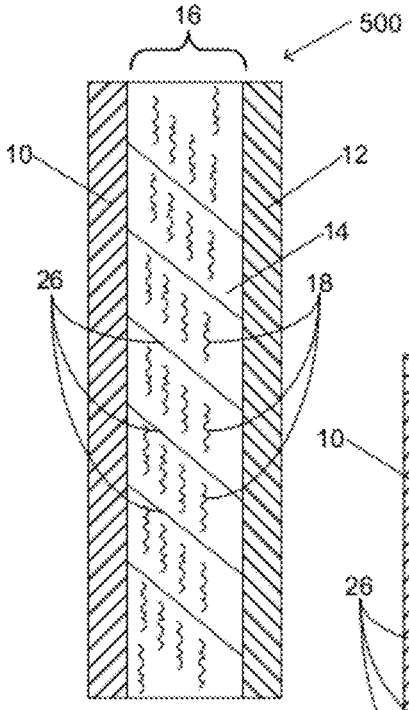
FIG. 5 is a side elevational view of a cross-section of a portion of an armor system in accordance with another embodiment of the present invention, including contact points.

FIG. 5 is a side elevational view of a cross-section of a portion of an armor system 500 in accordance with yet another embodiment of the present invention. Except as described in the following, the embodiment illustrated in FIG. 5 is substantially similar to the embodiment illustrated in FIG. 1. In the FIG. 5 embodiment, the armor system 500 includes a plurality of structural contact points 26 disposed in contact with the first armor layer 10 and the second armor layer 12 and adapted to maintain the layers in the spaced apart relationship. In some embodiments, the contact points 26 also provide enhanced functionality to the armor system 400, in that these structures, by collapsing, bending or otherwise yielding, can absorb a portion of the energy applied to the armor system 400 by an incoming projectile or energetic force. The contact points 26 may be formed as trusses (e.g., wire truss), baffles, rods, plates, bumps on the surface of either or both of the first armor layer 10 or the second armor layer 12, or other similar structures capable of providing this function.

Figure 6:
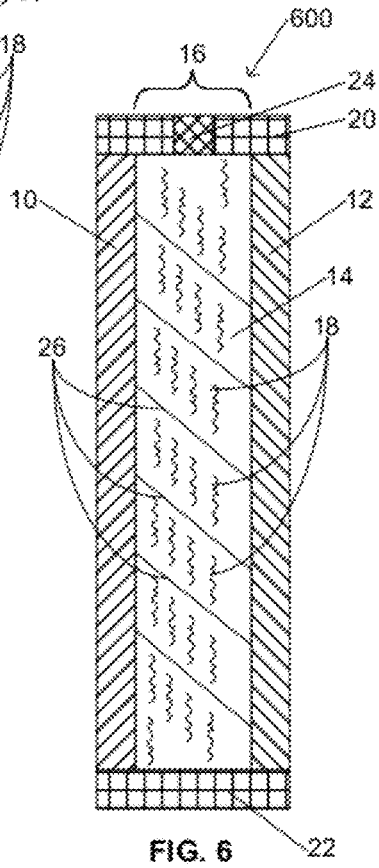
FIG. 6 is a side elevational view of a cross-section of a portion of an armor system in accordance with still another embodiment of the present invention, similar to the embodiment of FIG. 5.

FIG. 6 is a side elevational view of a cross-section of a portion of an armor system 600 in accordance with still another embodiment of the present invention. The embodiment illustrated in FIG. 6 is substantially the same as the embodiment illustrated in FIG. 2, except that in FIG. 6, the armor system 600 includes contact points 26 such as described with respect to FIG. 5. Thus, the descriptions of FIG. 2 and FIG. 5 apply equally to the embodiment illustrated in FIG. 6, and so will not be repeated here for sake of brevity.

It is to be understood that the structural contact points 26, such as described with respect to FIG. 5 and applicable to FIG. 6, are representative of a variety of different core topologies that may be disposed in contact with the first armor layer 10 and the second armor layer 12 and adapted to maintain the layers in the spaced apart relationship. Many such core topologies are known and commercially available, for example, from Cellular Materials International, Inc., Charlottesville, Va. and/or from HEXCEL Corp., Stamford, Conn. Suitable topologies include tetrahedral, pyramidal, bi-layer tetrahedral, Kagome, diamond textile, square honeycomb, hexagonal honeycomb, triangular honeycomb, regular prismatic, diamond prismatic, egg-box and flat single corrugation. It is noted that, for use in the present application, certain of these topologies may be modified to enhance movement of the fluid 14 in and out of the void volume 16 in the embodiments of the present invention which include the structural contact points 26.

Figure 7:
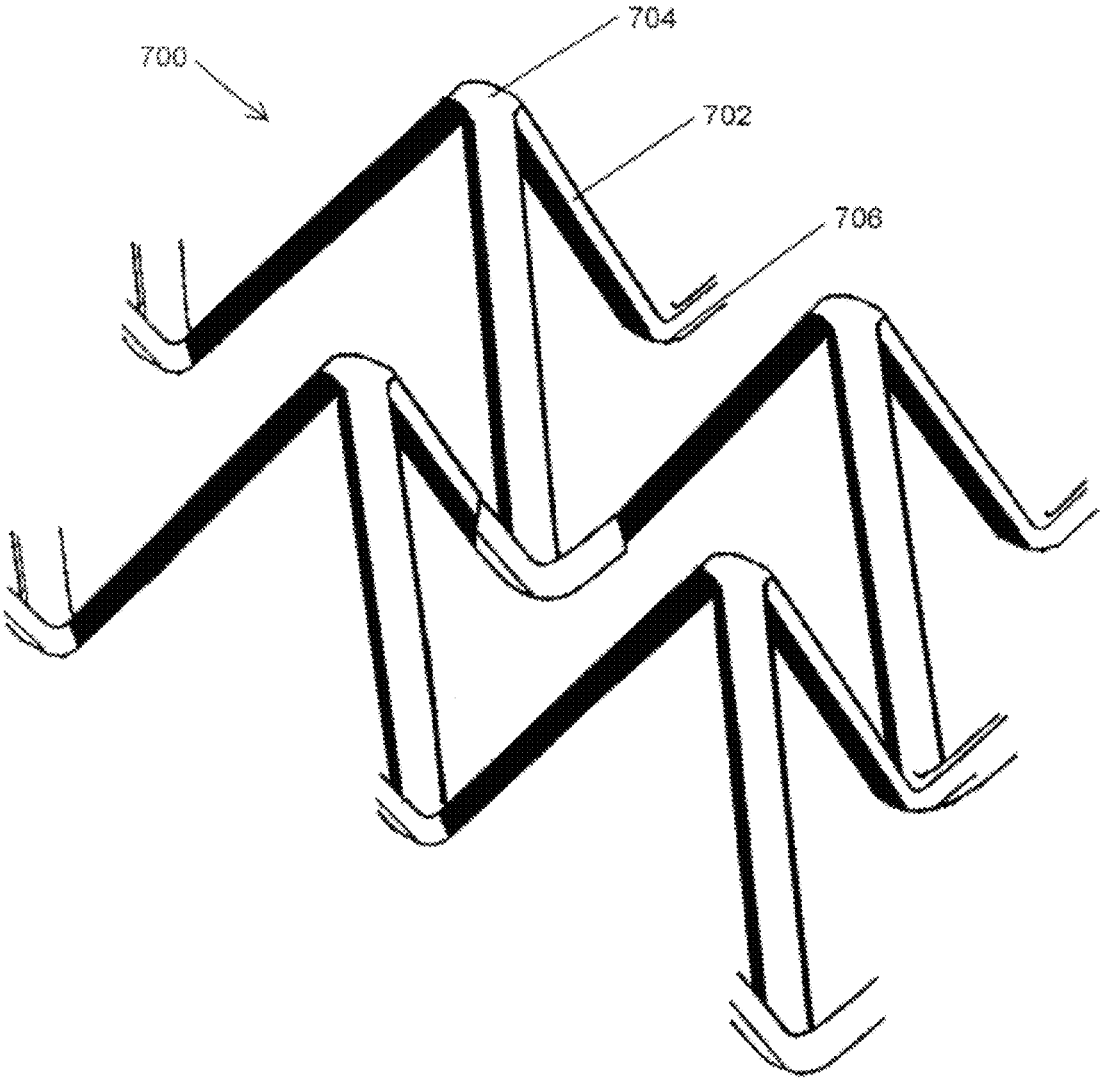
FIG. 7 is a perspective view of a portion of a structural contact point structure having a tetrahedral topology that may be employed with embodiments of the present invention.

FIG. 7 is a perspective view of a portion of a structural contact point structure 700 having a tetrahedral topology that may be employed with embodiments of the present invention, such as described above with respect to FIGS. 5 and 6. As noted, the structural contact points 26 may include a variety of structures. The structure 700 shown in FIG. 7 has been described as a tetrahedral truss core made up of triad units with leg members 702 having a selected length, such that the truss core structure has a selected and controllable height. This selectable and controllable height provides the capability of closely controlling the distance between the first armor layer 10 and the second armor layer 12, and provides great strength in maintaining these layers in spaced-apart relationship and in providing armor protection to the overall armor system, even when the fluid 14 is not present. As shown in FIG. 7, the leg members 702 of the structure 700 have an upper leg end 704 and a lower leg end 706. In use, the upper leg end 704 will be in contact with one of the first or second armor layer, while the lower leg end 706 will be in contact with the other of the first or second armor layer. The leg ends may be attached to the respective armor layer by any appropriate means, such as glue, welding, soldering, etc., as will be recognized and by any known method for attaching metal and/or non-metal parts together. In general, the structure 700 is made of metal, and in one embodiment of the same metal from which the armor layers to which it is attached are made. In other embodiments, the structure 700 is made of a material other than metal, and in another embodiment, the structure 700 is made of a material that is different from one or both of the armor layers to which it is attached. Such cellular metal truss core structures, and their use in "sandwich" armor structures, are disclosed by Sypeck, et al., "Cellular Metal Truss Core Sandwich Structures", Advanced Engineering Materials 2002, Vol. 4, No. 10, pp. 759-764. Additional information on such structures may be found, for example, in Lim, et al., "Mechanical behavior of sandwich panels with tetrahedral and Kagome truss cores fabricated from wires", Int. J. Solids and Structures 43 (2006) 5228-5246 and in Wadley et al., "Fabrication and structural performance of periodic cellular metal sandwich structures", Composites Science and Technology 63 (2003) 2331-2343. Methods for making truss core sandwich structures and the resulting structures are disclosed in U.S. Pat. No. 7,424,967, which may be consulted for additional information relating to such structures and methods of making them. The disclosure of U.S. Pat. No. 7,424,967 is incorporated herein by reference for its teachings relating to methods for making truss core sandwich structures and the resulting structures.

The truss core structure illustrated in FIG. 7 is a tetrahedral truss core, used to form the structural contact points 26. Other known truss cores may be used as well, particularly a pyramidal truss core and/or a Kagome truss core and/or a lattice block truss core. In addition, in other embodiments, the structural contact points 26 may include, for example, any of the configurations mentioned above.

Figure 8:
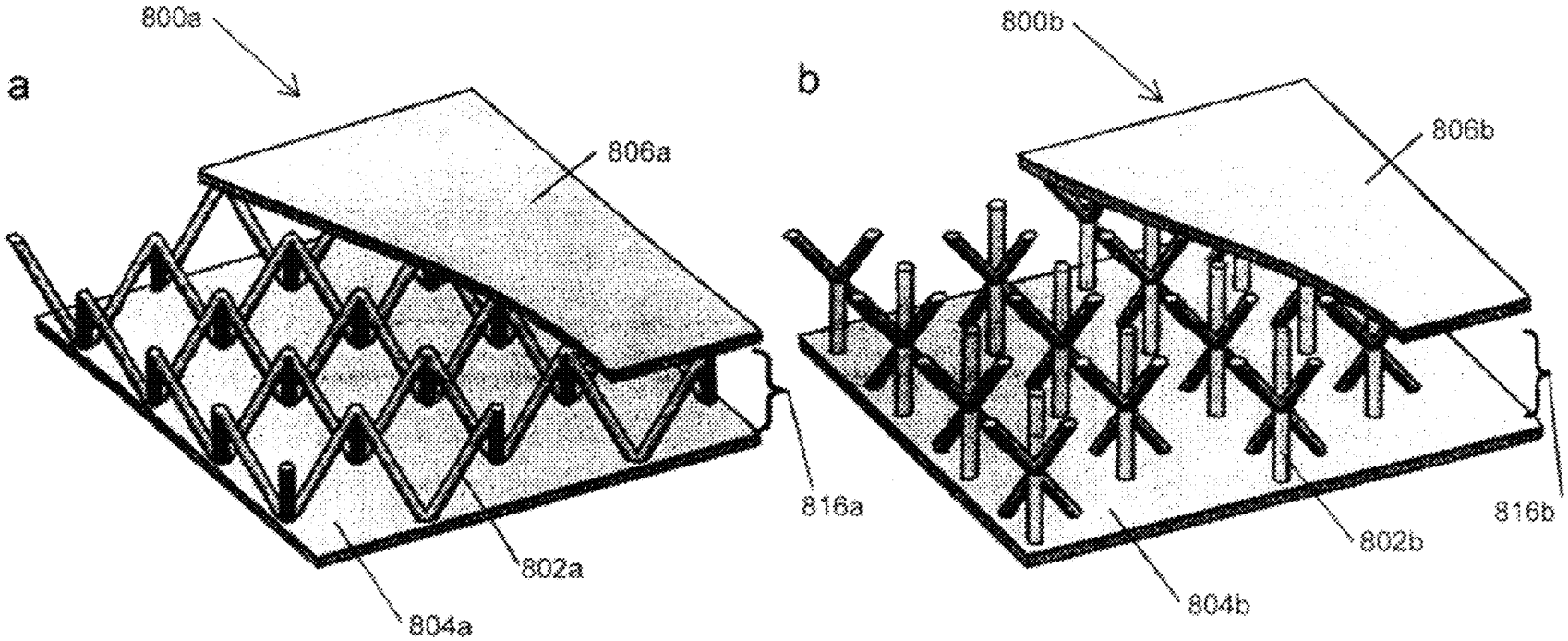
FIG. 8 is a perspective partial cutaway view of two embodiments of strut core structural contact point structures with associated armor layers that may be employed with embodiments of the present invention.

FIG. 8 is a perspective partial cutaway view of two embodiments (a) and (b) of strut core structural contact point structures with associated armor layers that may be employed with embodiments of the present invention. In FIG. 8 (*a*), an armor system 800*a* is illustrated. In the armor system 800*a*, a tetrahedral truss core 802*a* is disposed between a first armor plate 804*a* and a second armor plate 806*a*, which are separated by a void volume 816*a*. In accordance with an embodiment of the present invention, the void volume 816*a* will removably contain the viscoelastic fluid. In FIG. 8 (*b*), an armor system 800*b* is illustrated. In the armor system 800*b*, a Kagome truss core 802*b* is disposed between a first armor plate 804*b* and a second armor plate 806*b*, which are separated by a void volume 816*b*. In accordance with an embodiment of the present invention, the void volume 816*b* will removably contain the viscoelastic fluid. As noted above, other embodiments of truss core may be used in configurations corresponding to those illustrated in FIGS. 8 (*a*) and (*b*).

Figure 9:
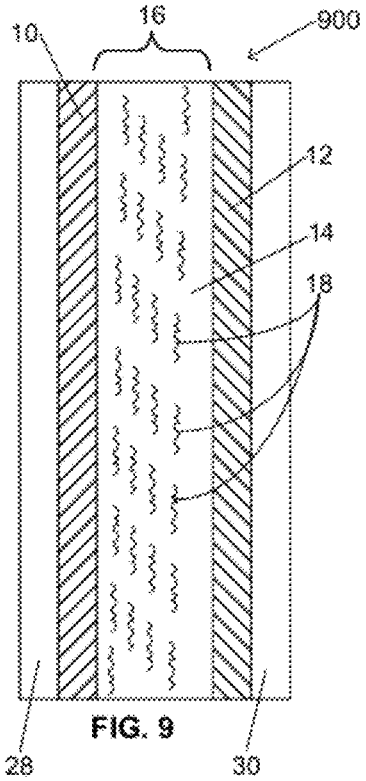
FIG. 9 is a side elevational view of a cross-section of a portion of an armor system in accordance with an embodiment of the present invention, including additional external layers.

FIG. 9 is a side elevational view of a cross-section of a portion of an armor system 900 in accordance with an embodiment of the present invention. The embodiment illustrated in FIG. 9 is substantially the same as the embodiment illustrated in FIG. 1, except that in FIG. 8, the armor system 900 includes an auxiliary outer front layer 28 applied on the outer surface of the first armor layer 10 and an outer auxiliary rear layer 30 applied on the outer surface of the second armor layer 12. The term "front" is used to indicate that the additional, auxiliary outer layer 28 is on the side of the armor system 800 facing towards the incoming threat, and the term "rear" is used to indicate that the additional, auxiliary outer layer 30 is on the side of the armor system 900 facing away from the incoming threat, which would may also be on the interior side of the armor system. The term "outer" in the auxiliary layers 28 and 30 is used to indicate that these layers are disposed on the outer surfaces of the armor system, as described with respect to FIGS. 9-11, as opposed to the inner surfaces, facing the void volume 16, as described below with respect to FIGS. 12 and 13. These definitions apply as appropriate to the embodiments illustrated in FIGS. 9-13.

Figure 10:
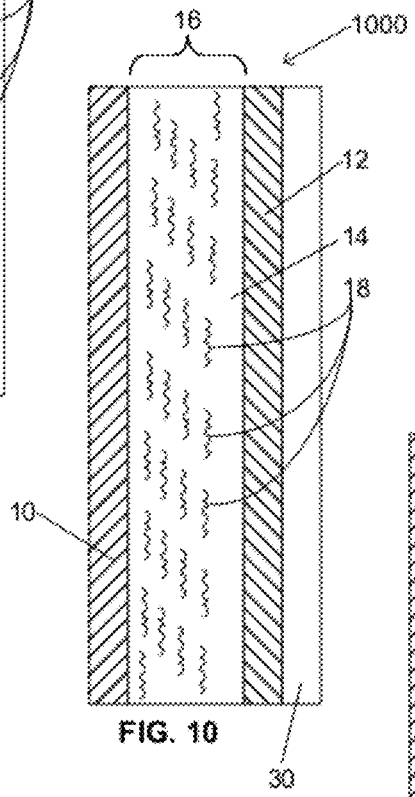
FIG. 10 is a side elevational view of a cross-section of a portion of an armor system in accordance with yet another embodiment of the present invention, including an additional external layer.

FIG. 10 is a side elevational view of a cross-section of a portion of an armor system 1000 in accordance with yet another embodiment of the present invention. The embodiment illustrated in FIG. 10 is substantially the same as the embodiment illustrated in FIG. 1, except that in FIG. 10, the armor system 1000 includes an auxiliary outer rear layer 30 applied on the outer surface of the second armor layer 12, but no auxiliary outer front layer.

Figure 11:
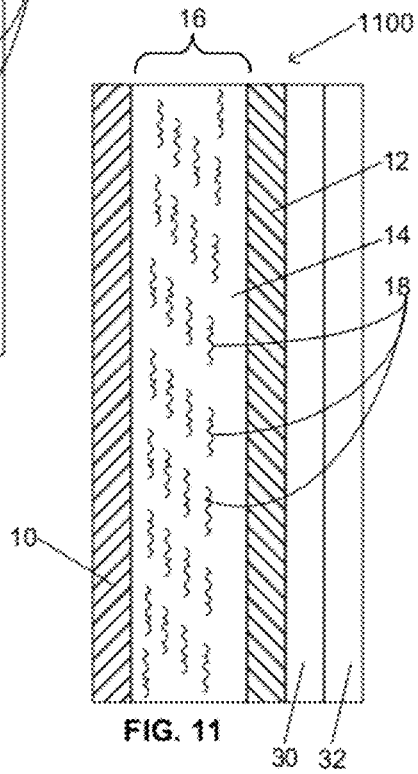
FIG. 11 is a side elevational view of a cross-section of a portion of an armor system in accordance with still another embodiment of the present invention, similar to FIG. 10 but including two additional external layers.

FIG. 11 is a side elevational view of a cross-section of a portion of an armor system 1100 in accordance with still another embodiment of the present invention. The embodiment illustrated in FIG. 11 is substantially the same as the embodiment illustrated in FIG. 1, except that in FIG. 11, the armor system 1100 includes a first auxiliary outer rear layer 30 applied on the outer surface of the second armor layer 12 and a second auxiliary outer rear layer 32 applied on the outer surface of the first auxiliary rear layer 30.

In another embodiment, similar to FIG. 11 but not shown, an auxiliary outer front layer 28 could be provided on the outer surface of the first armor layer 10, with no auxiliary outer rear layer provided. Similarly, in another embodiment, similar to FIG. 11 but not shown, two auxiliary outer front layers could be provided on the outer surface of the first armor layer 10, with no auxiliary outer rear layer provided. These alternate embodiments are considered to be within the scope of the invention, although not shown.

Figure 12:
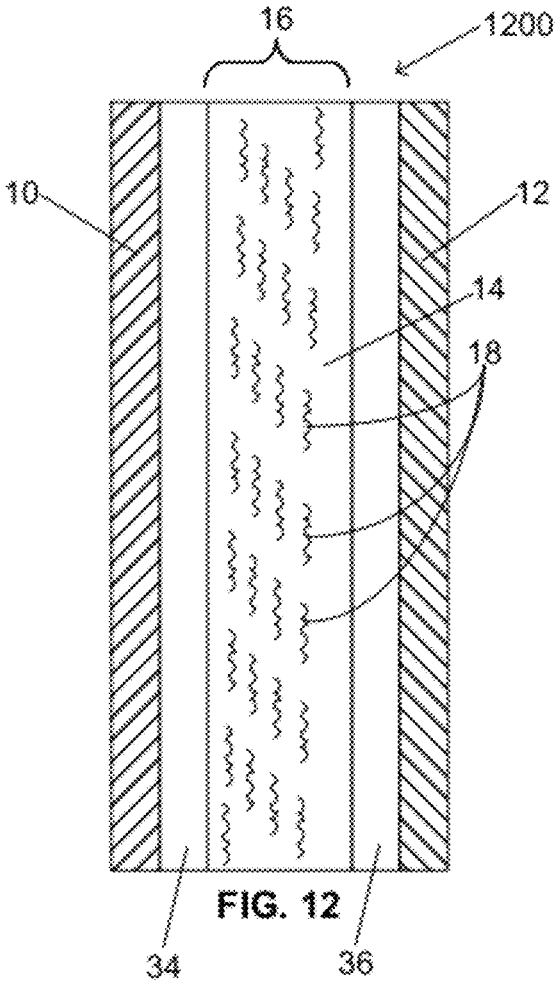
FIG. 12 is a side elevational view of a cross-section of a portion of an armor system in accordance with yet another embodiment of the present invention, including additional internal layers.

FIG. 12 is a side elevational view of a cross-section of a portion of an armor system 1200 in accordance with an embodiment of the present invention. The embodiment illustrated in FIG. 12 is substantially the same as the embodiment illustrated in FIG. 1, except that in FIG. 12, the armor system 1200 includes an auxiliary inner front layer 34 applied on the inner surface of the first armor layer 10 and an inner auxiliary rear layer 36 applied on the inner surface of the second armor layer 12. Thus, in this embodiment, the auxiliary inner front layer 34 and the auxiliary inner rear layer 36 are on the insides of the first armor layer 10 and the second armor layer 12, facing the void volume 16 and, when the void volume 16 contains a fluid 14, in contact with the fluid 14.

Figure 13:
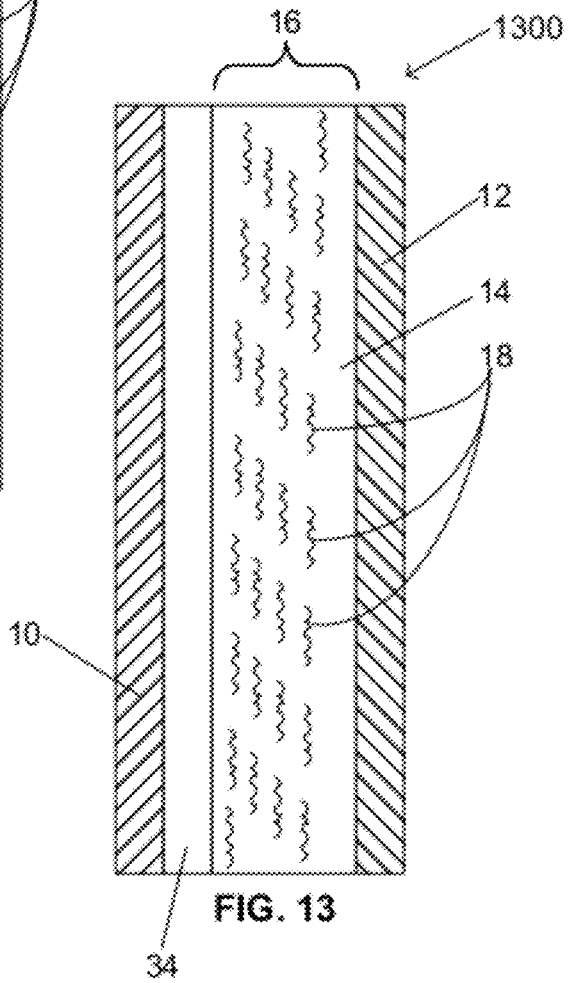
FIG. 13 is a side elevational view of a cross-section of a portion of an armor system in accordance with still another embodiment of the present invention, including an additional internal layer.

FIG. 13 is a side elevational view of a cross-section of a portion of an armor system 1300 in accordance with yet another embodiment of the present invention. The embodiment illustrated in FIG. 13 is substantially the same as the embodiment illustrated in FIG. 1, except that in FIG. 13, the armor system 1300 includes an auxiliary inner front layer 34 applied on the inner surface of the first armor layer 10, but no auxiliary inner rear layer. Thus, in this embodiment, the auxiliary inner front layer 34 is on the inside of the first armor layer 10, facing the void volume 16 and, when the void volume 16 contains a fluid 14, in contact with the fluid 14.

In another embodiment, similar to FIG. 13 but not shown, an auxiliary inner rear layer 36 could be provided on the inner surface of the second armor layer 12, with no auxiliary inner front layer provided. Similarly, in another embodiment, similar to FIG. 12 but not shown, multiple auxiliary inner front and/or rear layers could be provided on the inner surfaces of the first armor layer 10 and/or of the second armor layer 12. These alternate embodiments are considered to be within the scope of the invention, although not shown.

The auxiliary layers 28, 30, 32, 34 and 36, variously shown in FIGS. 9-13, may be made of any suitable material known for use in an armor system. Such layers may be or comprise a material, e.g., a metal, having different physical properties than the material of which the first armor layer 10 and/or the second armor layer 12 are composed. Such layers may be or comprise a polymeric material, a fiber-containing polymeric or other material, a metal having different hardness, toughness, shock-absorbing or other characteristics. Suitable materials for the auxiliary layers are known in the art, and any such material may be suitably used for the embodiments shown in FIGS. 9-13.

In addition to the foregoing specifically illustrated and described embodiments, specific disclosure is hereby included of all possible combinations of each of the embodiments disclosed in the foregoing. Thus, for example, embodiments are contemplated in which the first armor layer and the second armor layer are augmented by the presence of any combination of any or both of the foregoing external and internal auxiliary layers. Specifically exemplified combinations include a combination of the embodiments illustrated in FIG. 3 or FIG. 4 with any one or more of the embodiments illustrated in any of FIG. 6, 9, 10, 11, 12 or 13. In addition, specifically exemplified combinations include a combination of the embodiment illustrated in FIG. 6 with any one or more of the embodiments illustrated in any of FIG. 3, 4, 9, 10, 11, 12 or 13. In addition, specifically exemplified combinations include a combination of the embodiments illustrated in FIG. 3 or FIG. 4 with the embodiment illustrated in FIG. 6 together with any one or more of the embodiments illustrated in any of FIG. 9, 10, 11, 12 or 13. Furthermore, any of the various truss core structures illustrated in FIGS. 7 and 8, or other core structures disclosed herein, may be employed in combination with any of the embodiments disclosed herein, as described above with respect to FIGS. 5 and 6. Thus, all possible combinations of the various individual embodiments illustrated herein are fully disclosed and unambiguously contained within the scope of the present invention, as will be readily appreciated by the person of skill in the art.

In one embodiment, the first armor layer and the second armor layer each comprise properties of hardness, thickness, fracture toughness, impact resistance, tensile strength, corrosion resistance and weldability, and wherein one or more of the properties are different between the first armor layer and the second armor layer but are complementary in providing protection against penetration of the armor system by projectiles. Each of these properties may be selected as appropriate for a given armor system and a given set of threats from which protection is to be provided by the system.

As is known in the art, each of these properties can affect the protection capability of an armor system. In some cases, a given armor material (e.g., an aluminum alloy such as 5083 or 7039) may have properties that are more valuable and useful when used in an outer armor layer or when used in an inner armor layer, or when designed to protect against a given threat. The selection of the appropriate combination of these armor properties is well within the skill of those in the armor art. The present invention, when used with appropriately selected materials, provides enhanced protection and provides increased capability of combining materials having complementary properties, due to this enhanced protection. That is, by providing the enhanced protection capability disclosed in the present specification, designers of armor systems will be able to select and combine a wider range of materials to provide a synergistic enhancement of protection, that is not available without use of the fluid comprising the viscoelastic surfactant as an energy absorbing medium in the void volume of an armor system.

Thus, for example, when incorporating the fluid comprising the viscoelastic surfactant in accordance with the present invention, an armor system providing the same level of protection but in which the armor layers are thinner and/or lighter in weight, as compared to a similar system without the fluid, can be made. In one embodiment, the thickness and/or weight of the armor layers can be reduced from about 5% to about 25%, when used in accordance with the present invention, as compared to a similar system using the same materials but without using the fluid comprising the viscoelastic surfactant as an energy absorbing medium in the void volume of an armor system. In one embodiment, the thickness and/or weight of the armor layers can be reduced from about 10% to about 15%, when used in accordance with the present invention, as compared to a similar system using the same materials but without using the fluid comprising the viscoelastic surfactant as an energy absorbing medium in the void volume of an armor system.

In accordance with the present invention, the fluid comprising the viscoelastic surfactant is useful as an energy absorbing medium when used in the void volume of the armor system as described herein.

Viscoelastic Surfactants and Fluids Containing Same

The term "viscoelastic" refers to those viscous fluids having elastic properties, i.e., the fluid at least partially returns to its original, viscous form when an applied stress is released, but is non-viscous or of reduced viscosity when under shear stress in particular. In their thickened state, the viscoelastic fluids provide enhanced energy absorption characteristics when used in accordance with the present invention, as described herein. Viscoelastic fluids have previously been found to be useful as water-based hydraulic fluids in lubricant and hydraulic fracturing fluids to increase permeability in oil production.

Viscoelastic surfactants are known in the art as surfactants which can form elongated, rodlike, wormlike and/or entangled micellular structures in a fluid, which give rise to significantly increased viscosity in the fluid, as opposed to more conventional spherical micelles formed by most surfactants, which do not give rise to significantly increased viscosity in the fluid. The formation of such viscosifying micelles creates useful rheological properties. The viscoelastic surfactant solution exhibits shear thinning behavior, and remains stable despite repeated high shear applications. The elongated, rodlike, wormlike and/or entangled micellular structures may also be referred to as "viscosifying micelles". A fluid comprising a viscoelastic surfactant at a concentration sufficient to exhibit pseudosolid elastic behavior conveniently may be referred to as a viscoelastic surfactant fluid or simply as a viscoelastic fluid, and all of these terms may be used interchangeably herein. Viscoelastic fluids are those in which the application of stress gives rise to a strain that approaches its equilibrium value relatively slowly. Therefore, viscoelastic fluids may behave as a viscous fluid or an elastic solid, depending upon the stress on the system. Viscoelasticity in fluids that is caused by surfactants can manifest itself in shear rate thinning behavior. For example, when such a fluid is passed through a pump or is in the vicinity of a rotating drill bit, the fluid exhibits low viscosity. When the shearing force is abated the fluid returns to its more viscous condition. This is because the viscoelastic behavior is caused by surfactant aggregations in the fluid. These aggregations will adjust to the conditions of the fluid, and will form different aggregation shapes under different shear stress. Thus one can have a fluid that behaves as a viscous fluid under low shear, and a low viscosity fluid under a higher shear. A viscoelastic fluid also has an elastic component which manifests itself in yield value. This allows a viscoelastic fluid to suspend an insoluble material, for example sand (e.g., for use in drilling operations), for a greater time period than a viscous fluid of the same apparent viscosity. Thus, viscoelastic fluids have been used in oilfield operations for a number of years.

The property of viscoelasticity in general is well known and reference is made to Hoffmann et al., "Influence of Ionic Surfactants on the Viscoelastic Properties of Zwitterionic Surfactant Solutions", Langmuir, 8, 2140-2146 (1992); and Hoffmann et al., The Rheological Behaviour of Different Viscoelastic Surfactant Solutions, Tenside Surf. Det., 31, 389-400, 1994. Of the test methods specified by these references to determine whether a fluid possesses viscoelastic properties, one test which may be useful in determining the viscoelasticity of an aqueous solution consists of swirling the solution and visually observing whether the bubbles created by the swirling recoil after the swirling is stopped. Any recoil of the bubbles indicates viscoelasticity. Another test which may be useful is to measure the storage modulus (G') and the loss modulus (G") at a given temperature. If G'>G" at some point or over some range of points below about 10 rad/sec, typically between about 0.001 to about 10 rad/sec, more typically between about 0.1 and about 10 rad/sec, at a given temperature and if $G'>10^{-2}$ Pascals, preferably $10^{-1}$ Pascals, the fluid is typically considered viscoelastic at that temperature. Rheological measurements such as G' and G" are discussed more fully in "Rheological Measurements", Encyclopedia of Chemical Technology, vol. 21, pp. 347-372, (John Wiley & Sons, Inc., N.Y., N.Y., 1997, 4th ed.). To the extent necessary for completion, the above disclosures are incorporated herein by reference.

In accordance with one embodiment of the present invention, any known viscoelastic surfactant that can be dispersed in a suitable fluid (e.g., water) at a concentration sufficient to exhibit pseudosolid elastic behavior is suitable for use with the present invention as a viscoelastic fluid. That is, the invention is not limited to any particular viscoelastic surfactant, so long as the desired physical properties can be obtained and, in some embodiments, reversibly employed.

In accordance with the present invention, the viscoelastic surfactants may be selected from a group of surfactant materials and compositions capable of forming the wormlike micelles characteristic of viscoelastic surfactants that can exhibit pseudosolid elastic behavior. In one embodiment, the viscoelastic surfactant is able to form the wormlike micelles over a broad range of concentrations, such as 1 to 8 percent by weight, in the fluid such as an aqueous fluid.

Suitable viscoelastic surfactants are described, for example, in the following U.S. Pat. Nos. 3,361,213; 3,273,107; 3,406,115 4,061,580; 4,534,875; 5,964,295; 5,979,557; 6,306,800; 6,637,517; and 6,258,859, each of which can be consulted for additional details regarding viscoelastic surfactants, and the disclosure of each of which relating to viscoelastic surfactants is incorporated herein by reference.

In one embodiment, the viscoelastic surfactants suitable for use in the fluids herein include, but are not necessarily limited to, non-ionic, cationic, amphoteric, and zwitterionic surfactants. Specific examples of zwitterionic/amphoteric surfactants include, but are not necessarily limited to, dihydroxyl alkyl glycinate, alkyl ampho acetate or propionate, alkyl betaine, alkyl amidopropyl betaine and alkylimino mono- or di-propionates derived from certain waxes, fats and oils. Quaternary amine surfactants are typically cationic, and the betaines are typically zwitterionic. The thickening agent may be used in conjunction with an inorganic water-soluble salt or organic additive such as phthalic acid, salicylic acid or their salts.

In one embodiment, amine oxide viscoelastic surfactants are believed to have the potential to offer more gelling power per pound, making it less expensive than other fluids of this type.

In one embodiment, the viscoelastic surfactant has a the formula $(R^1—X)_nZ$, in which $R^1$ is an aliphatic group comprising a principal straight chain bonded at a terminal carbon atom thereof to X, the straight chain having a length such that a viscoelastic fluid is formable by the surfactant in aqueous media; and further comprising at least one side chain (the carbon atoms of the side chain not being counted with the carbon atoms of the principal straight chain) which is shorter than the principal straight chain, the side chain enhancing the solubility of the surfactant in hydrocarbons, and being sufficiently close to the head group and sufficiently short such that the surfactant forms micelles in the viscoelastic fluid. X is a charged head group, Z is a counterion, and n is an integer which ensures that the surfactant is charge neutral. In one embodiment, the principal straight chain is a $C_{10}$-$C_{25}$ straight chain. In one embodiment, the side chain is a $C_1$-$C_6$ side chain. X may be a carboxylate, quaternary ammonium, sulphate, or sulphonate charged group. When X is a carboxylate, sulphate, or sulphonate group, Z may be an alkali metal cation (in which case n is one) or an alkaline earth metal cation (in which case n is two). In one embodiment, Z is $Na^+$ or $K^+$. When X is a quaternary ammonium group, Z may be a halide anion, such as $Cl^-$ or $Br^-$, or a small organic anion, such as a salicylate. In both these cases n is one. In one embodiment, the principal straight chain is a $C_{16}$-$C_{24}$ chain, and in another embodiment, it is a $C_{18}$ or a $C_{22}$ chain.

In one embodiment, the viscoelastic surfactant is an amine oxide. The amine oxide viscoelastic surfactants $RN^+(R')_2O^-$ may have the following structure:

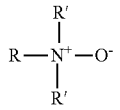

wherein R is an alkyl or alkylamido group averaging from about 8 to 24 carbon atoms and R' are independently alkyl groups averaging from about 1 to 6 carbon atoms. In one non-limiting embodiment, R is an alkyl or alkylamido group averaging from about 8 to 16 carbon atoms and each R' is independently an alkyl group averaging from about 2 to 3 carbon atoms. In an alternate, non-restrictive embodiment, the amine oxide viscoelastic surfactant is tallow amido propylamine oxide (TAPAO), which should be understood as a dipropylamine oxide since both R' groups are propyl.

In one embodiment, the viscoelastic surfactant is erucyl bis(2-hydroxyethyl) methyl ammonium chloride. In other alternate embodiments, other or additional surfactants may be used either alone or in combination, including erucyl trimethyl ammonium chloride; N-methyl-N,N-bis(2-hydroxyethyl) rapeseed ammonium chloride; oleyl methyl bis(hydroxyethyl) ammonium chloride; octadecyl methyl bis (hydroxyethyl) ammonium bromide; octadecyl tris (hydroxyethyl) ammonium bromide; octadecyl dimethyl hydroxyethyl ammonium bromide; cetyl dimethyl hydroxyethyl ammonium bromide; cetyl methyl bis(hydroxyethyl) ammonium salicylate; cetyl methyl bis(hydroxyethyl) ammonium 3,4-dichlorobenzoate; cetyl tris(hydroxyethyl) ammonium iodide; bis(hydroxyethyl) soya amine; N-methyl, N-hydroxyethyl tallow amine; bis(hydroxyethyl) octadecyl amine; cosyl dimethyl hydroxyethyl ammonium bromide; cosyl methyl bis(hydroxyethyl) ammonium chloride; cosyl tris(hydroxyethyl) ammonium bromide; dicosyl dimethyl hydroxyethyl ammonium bromide; dicosyl methyl bis(hydroxyethyl) ammonium chloride; dicosyl tris(hydroxyethyl) ammonium bromide; hexadecyl ethyl bis(hydroxyethyl) ammonium chloride; hexadecyl isopropyl bis(hydroxyethyl) ammonium iodide; N,N-dihydroxypropyl hexadecyl amine, N-methyl, N-hydroxyethyl hexadecyl amine; N,N-dihydroxyethyl dihydroxypropyl oleyl amine; N,N-dihydroxypropyl soya amine; N,N-dihydroxypropyl tallow amine; N-butyl hexadecyl amine; N-hydroxyethyl octadecyl amine; N-hydroxyethyl cosyl amine; cetylamino, N-octadecyl pyridinium chloride; N-soya-N-ethyl morpholinium ethosulfate; methyl-1-oleyl amido ethyl-2-oleyl imidazolinium-methyl sulfate; and methyl-1-tallow amido ethyl-2-tallow imidazolinium-methyl sulfate. The foregoing viscoelastic surfactants are among those disclosed in U.S. Pat. No. 5,964,295, which can be consulted for additional details regarding viscoelastic surfactants (therein referred to as "thickeners"), and the disclosure of which relating to viscoelastic surfactants is incorporated herein by reference. As noted above, the key characteristic is the ability to form worm-like micelles which may be entangled with one another, thus giving rise to the high viscosities attainable with the viscoelastic surfactants for use in the present invention.

In one embodiment, the viscoelastic surfactant is an amidoamine oxide of the general formula:

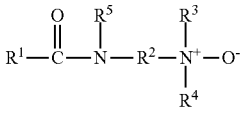

wherein $R^1$ is a saturated or unsaturated, straight or branched chain aliphatic group of from about 7 to about 30 carbon atoms, $R^2$ is a divalent alkylene group of 2-6 carbon atoms which may be linear or branched, substituted or unsubstituted, and $R^3$ and $R^4$ are independently $C_1$-$C_4$ alkyl or hydroxyalkyl groups or together they form a heterocyclic ring of up to six members including the N atom, and $R^5$ is hydrogen or a $C_1$-$C_4$ alkyl or hydroxyalkyl group. This group of viscoelastic surfactants is disclosed in U.S. Pat. No. 6,506,710 B1, which can be consulted for additional details regarding viscoelastic surfactants, and the disclosure of which relating to viscoelastic surfactants is incorporated herein by reference.

In one embodiment, the viscoelastic surfactants can be either ionic or nonionic. In one embodiment, the present invention comprises use of an aqueous viscoelastic surfactant based on amphoteric or zwitterionic surfactants. The amphoteric surfactant is a class of surfactant that has both a positively charged moiety and a negatively charged moiety over a certain pH range (e.g. typically slightly acidic), only a negatively charged moiety over a certain pH range (e.g. typically slightly alkaline) and only a positively charged moiety at a different pH range (e.g. typically moderately acidic), while a zwitterionic surfactant has a permanently positively charged moiety in the molecule regardless of pH and a negatively charged moiety at alkaline pH.

In one embodiment, the viscoelastic fluid comprises water, surfactant, and a water-soluble compound selected from organic acids, organic acid salts, inorganic salts, and mixtures thereof. Alternatively, in another embodiment, the viscoelastic fluid can comprise water, an amine oxide surfactant and an anionic surfactant containing a hydrophobe having at least about 14 carbon atoms.

In one embodiment, the viscoelastic surfactant may be of the following formula: R—Z, where R is the hydrophobic tail of the surfactant, which is a fully or partially saturated, linear, branched or alicyclic hydrocarbon chain of at least 14 carbon atoms, and Z is the head group of the surfactant, which may be for example $—NR^1R^2O$ (amphoteric), $—N^+R^1R^2R^3$ (cationic), $—SO_3^-$, $—COO^-$ (anionic) or, in the case where the surfactant is zwitterionic, $—N^+(R^1)(R^2R^3)—COO^-$ (betaine) or $—N^+(R^1)(R^2)R^3—SO_3^-$ (sultaine), where $R^1$, $R^2$ and $R^3$ are each independently hydrogen or a fully or partially saturated, linear or branched, aliphatic chain of at least one carbon atom; and where $R^1$ or $R^2$ may comprise a hydroxyl terminal group. This group of viscoelastic surfactants is disclosed in U.S. Published Application No. 2008/0269081 A1, which can be consulted for additional details regarding viscoelastic surfactants, and the disclosure of which relating to viscoelastic surfactants is incorporated herein by reference.

In another embodiment, examples of zwitterionic viscoelastic surfactants useful in the present invention are represented by the formula:

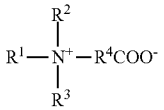

wherein $R^1$ represents a hydrophobic moiety of alkyl, alkylarylalkyl, alkoxyalkyl, alkylaminoalkyl and alkylamidoalkyl, wherein alkyl represents a group that contains from about 12 to about 24 carbon atoms which may be branched or straight chained and which may be saturated or unsaturated. Representative long chain alkyl groups include tetradecyl (myristyl), hexadecyl (cetyl), octadecentyl (oleyl), octadecyl (stearyl), docosenoic (erucyl) and the derivatives of tallow, coco, soya and rapeseed oils. In one embodiment, the alkyl and alkenyl groups are alkyl and alkenyl groups having from about 16 to about 22 carbon atoms. Representative of alkylamidoalkyl is alkylamidopropyl with alkyl being as described above. $R^2$ and $R^3$ are independently an aliphatic chain, e.g., alkyl, alkenyl, arylalkyl, hydroxyalkyl, carboxyalkyl, and hydroxyalkyl-polyoxyalkylene (e.g., hydroxyethyl-polyoxyethylene or hydroxypropyl-polyoxypropylene) having from 1 to about 30 atoms, in one embodiment from about 1 to about 20 atoms, in another embodiment from about 1 to about 10 atoms and in yet another embodiment from about 1 to about 6 atoms in which the aliphatic group can be branched or straight chained, saturated or unsaturated. In one embodiment, the alkyl chains $R^2$ and $R^3$ are methyl or ethyl, in one embodiment the arylalkyl is benzyl, and in one embodiment the hydroxyalkyls are hydroxyethyl or hydroxypropyl, while preferred carboxyalkyls are acetate and propionate. $R^4$ may be a hydrocarbyl radical (e.g. alkylene) with chain length 1 to 4, and in one embodiment $R^4$ is a methylene or ethylene group.

In another embodiment, amphoteric viscoelastic surfactants useful in the present invention include those represented by the formula:

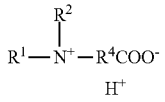

wherein $R^1$, $R^2$, and $R^4$ are the same as defined above. The foregoing zwitterionic and amphoteric viscoelastic surfactants are disclosed in U.S. Pat. No. 6,258,859 B1, which can be consulted for additional details regarding viscoelastic surfactants, and the disclosure of which relating to viscoelastic surfactants is incorporated herein by reference.

Although certain examples of suitable viscoelastic surfactants have been disclosed in the foregoing, any viscoelastic surfactant that can exhibit pseudosolid elastic behavior when present in a suitable fluid and a suitable concentration may be used. Those of skill in the art can select additional appropriate viscoelastic surfactants and can determine suitable concentrations to obtain the desired effect, based on the disclosure herein.

The viscoelastic surfactant is employed in the present invention in an amount sufficient to measurably increase the viscosity of the fluid in which it is employed. The amount of the viscoelastic surfactant most advantageously employed will vary depending on a variety of factors including the desired viscosity of the fluid, the solution composition and the end use application of the fluid, including the temperatures and shear rates to which the flowing fluid will be exposed. In aqueous fluids, the viscoelastic surfactant is generally employed in a sufficient amount such that the fluid's viscosity is at least about 100, in one embodiment at least about 250, and in another embodiment at least about 500 centipoise at 25° C. when measured using a Brookfield viscometer, LVT type, Spindle No. 1 at 6 rpm. In general, the concentration of any specific viscoelastic surfactant employed to impart the desired viscosity to the fluid is easily determined by experimentation. In one embodiment, the viscoelastic surfactants may be employed in amounts ranging from about 0.01 to about 10 weight percent based on the weight of the viscoelastic surfactant and fluid. In another embodiment, the viscoelastic surfactant may be employed in amounts from about 0.05 to about 3 percent based on the weight of the fluid and the viscoelastic surfactant.

Figure 14:
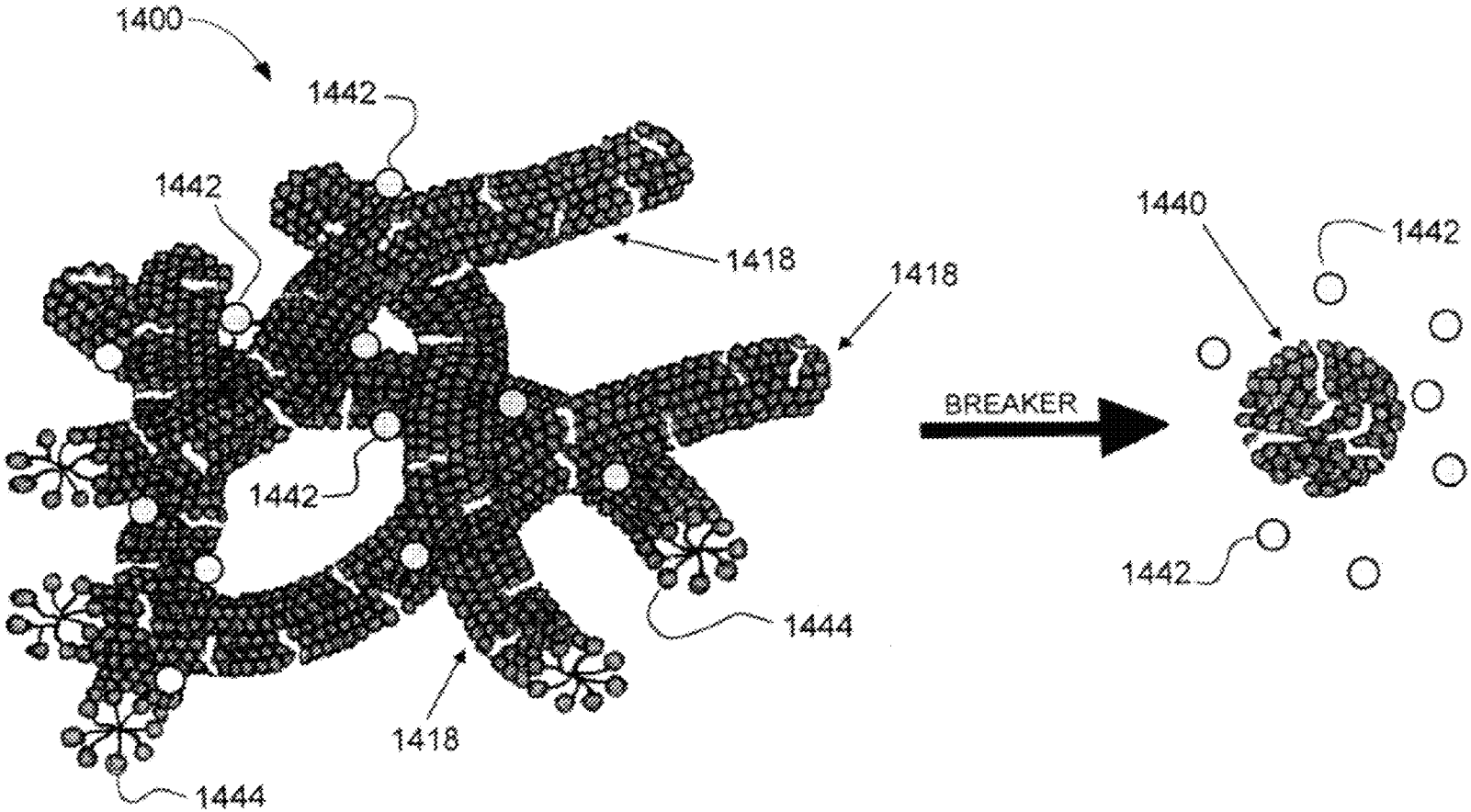
FIG. 14 is a schematic depiction of an entangled mass of viscoelastic surfactant molecules and of the return of these to a substantially spherical micellular form upon the addition of a suitable breaker.

FIG. 14 is a schematic depiction of an entangled mass 1400 of viscoelastic surfactant molecules 1418 and of the return of these to a substantially spherical micellular form 1440 upon the addition of a suitable breaker 1442. As illustrated in FIG. 14, when the viscoelastic surfactant molecules 1418 are in their entangled state, the entanglements cause the fluid to exhibit a very high viscosity, and this high viscosity provides greatly enhanced energy absorption capability and thereby improved armor protection. Thus, in the high-viscosity state, the fluid functions to enhance the armor protection provided. As illustrated in FIG. 14, upon addition of a suitable breaker 1442, the surfactant molecules revert to a more standard, micellular state 1440, in which the viscosity of the surfactant solution is much lower, approaching that of water or the base liquid. In the low-viscosity state, the fluid may be removed from the armor system, thereby greatly reducing the overall weight of the armor system, when the enhanced protection is no longer needed. This capability makes it much easier, for example, to transport the vehicle or system in which the armor system is deployed, when there is reduced threat level or when the vehicle or system must be moved by aircraft.

A further benefit of embodiments of the armor system of the present invention is that, in the scenario of an impacting projectile penetrating the outer armor layer, when the projectile and its heat and kinetic energy encounter the aqueous-based fluid comprising the viscoelastic surfactant between the outer armor layer and the inner armor layer, the fluid would not only absorb some of the kinetic energy, but could also absorb a significant quantity of the heat energy. Many projectiles penetrate armor by a combination of impact and burning through the metal of the armor layer. The specific heat of water is 1 calorie/gram° C.=4.186 joule/gram° C., which is higher than any other common substance, and is much higher than for a metal in particular. As a result, the water can play a very important role in temperature reduction upon impact of a projectile against an armor system containing an aqueous-based fluid, as in the present invention. Thus, in the scenario of a projectile penetrating the outer armor layer, at least a substantial portion of the heat associated with the projectile and its impact would be absorbed by the fluid comprising the viscoelastic surfactant. This would reduce the adverse effects on the inner armor layer, and possibly reduce the possibility that it would be breached as well. The fluid comprising a viscoelastic surfactant thus can provide a further measure of protection in the armor system in accordance with embodiments of the present invention.

An additional benefit of the armor system of embodiments of the present invention is that, in the worst-case scenario of the armor system being fully breached, the fluid comprising the viscoelastic surfactant may be released into the interior of the vehicle under protection. This release would result in the distribution of the fluid comprising the viscoelastic surfactant, while still in its high-viscosity condition, over most or all of the surfaces of both the interior and the occupants of the vehicle, thereby affording at least some protection from the otherwise devastating effects of the full breach of the armor system. The protection would be possible due to the heat-absorbing characteristics of the fluid, which is primarily aqueous, and would be enhanced by the fact that, since the fluid would still be in its high-viscosity state, the fluid would tend to remain in place on the surfaces with which it came into contact, rather than simply draining down and away from the effects of gravity. The fluid would thus form a protective coating and could potentially reduce the effects of the breach, such as the resulting extremely high temperatures. As is well known, in many cases in which an armor system has been breached, the primary injuries result from burns. Having a coating of a high-viscosity aqueous fluid would provide at least some protection from the high temperatures. This benefit would not be possible with the same system either with water only or with nothing in the same void volume. The fluid comprising a viscoelastic surfactant thus can act as a further measure of protection in the armor system in accordance with the present invention.

Breakers

As used herein, the term "breaker" is defined to include any substance or condition that is capable of decreasing the viscosity of a fluid containing a viscoelastic surfactant at a concentration sufficient to exhibit pseudosolid elastic behavior.

In accordance with an embodiment of the present invention, a breaker may be added to the fluid to enable the fluid to be removed from the void volume. Thus, in one embodiment, the method of the present invention further includes adding to the fluid a breaker to terminate the pseudosolid elastic behavior and to obtain a substantial decrease in viscosity of the fluid; and thereafter removing the fluid from the void volume. In most embodiments, the breaker is a chemical breaker, but other ways of breaking the pseudosolid elastic behavior of viscoelastic surfactants are known.

Thus, in one embodiment, the fluid in the void volume of the armor of the present invention comprises a viscoelastic surfactant at a concentration sufficient to exhibit pseudosolid behavior in the absence of a breaker, or in the absence of an activated internal breaker, as described in the following.

By enabling the removal of the fluid from the void volume, e.g., at a time when potential threats have been reduced or eliminated, the present invention may provide the additional benefit of significantly reducing the weight of the armor during such time. As will be understood, depending upon the relative mass of the first and second armor layers and the fluid disposed in the void volume, a very significant portion of the mass of the ballistic armor system can be reduced by removing the fluid from the void volume. This benefit enables a significant savings in fuel use and may also enable a significant increase in maneuverability and/or speed, by the military vehicle in which the ballistic armor system is deployed, when the fluid is removed and the vehicle must be transported.

As is known in the art of viscoelastic surfactants, certain materials, known as a breaker, when added to the fluid containing a viscoelastic surfactant at a concentration sufficient to exhibit pseudosolid elastic behavior, can "kill" the pseudosolid elastic behavior and return the fluid to a state of low viscosity. It is believed, based on knowledge in the art, that the breaker causes the viscoelastic surfactant to return to a spherical micellular form, from the entangled elongated micellular form present when the fluid comprising a viscoelastic surfactant is in a state of exhibiting the pseudosolid elastic behavior. Breakers decrease viscosity by degrading the internal structure of the viscoelastic surfactants in the fluid when the fluid comprises a viscoelastic surfactant at a concentration sufficient to exhibit pseudosolid elastic behavior.

The viscosity of fluids thickened with viscoelastic surfactants can be broken by a variety of means. For example, aqueous fluids thickened with hydrocarbyl or inertly-substituted hydrocarbyl viscoelastic surfactants can be broken through the addition of effective amounts of a miscible or immiscible hydrocarbon or substituted hydrocarbon such as methanol, ethanol, isopropanol, (i.e., lower alcohols) acetone, methylethylketone, trichloroethylene, toluene, xylenes, mineral oils, glycols, glycol ethers, and the like. Aqueous fluids containing the fluoroaliphatic species as viscoelastic surfactant components can be broken effectively using lower alcohols (i.e., alcohols having from 1 to about 3 carbon atoms) such as isopropanol. The amount of the hydrocarbon or substituted hydrocarbon which must be added to break the viscosity of the thickened fluid is dependent upon the specific viscoelastic surfactant employed and its concentration as well as the specific hydrocarbon or substituted hydrocarbon employed. For example, as little as 0.1 percent, by weight, based on the weight of the thickened fluid, of toluene can often be added to the fluid to break its viscosity whereas more than 75 weight percent of ethylene glycol may have to be added to break the same thickened fluid. In most instances, the hydrocarbon or substituted hydrocarbon will advantageously be selected such that it will break the viscosity when added in an amount from about 0.1 to about 50, or in one embodiment from about 0.2 to about 20, in another embodiment from about 0.2 to 10, weight percent based on the weight of the fluid.

Other methods for breaking the viscoelastic surfactant compositions involve changing the pH of the fluid, heating or cooling the system above or below that temperature at which the fluid loses its viscoelasticity, changing the composition of viscoelastic surfactants. Although the application of shear can be employed to break the viscoelastic properties imparted to the fluid by the surfactant, the application of excessive shear may not be a practical means of reducing the viscosity of the fluid in the present invention, at least for the purpose of removing the fluid from the void volume. It is understood that more than one means for breaking the viscoelastic surfactant compositions can be simultaneously employed.

In one embodiment, the viscosity of the viscoelastic surfactant fluid that has been broken can be restored. Restoration of the viscosity of the fluid can be accomplished using a variety of techniques. By the term "restoration of viscosity" is meant that the viscosity of the fluid which has been broken can be increased without the necessity of providing additional viscoelastic surfactant to the fluid. Thus, the term "reversible breaking" as used in referring to fluids in this invention refers to the repeated breaking and substantial restoration of viscosity of the original fluid. Examples of techniques useful in reversing the breaking process or restoring viscosity of the fluid include removal of the aforementioned hydrocarbon using techniques such as applying a vacuum and/or heat to the fluid. That is, the hydrocarbon or other breaker can be removed from the fluid by subjecting the fluid to conditions such that the hydrocarbon vaporizes. For this reason, it is most desirable to employ a hydrocarbon in the breaking process which has a fairly high vapor pressure under conditions of removal. Hydrocarbons can also be removed by absorbing the hydrocarbon using a suitable absorbing material (i.e., one which removes the hydrocarbon but not substantial amounts of the viscoelastic surfactant composition). For example, the hydrocarbon can be removed using polymeric beads, columns containing such beads, carbon, colloidal silica, etc. Other methods for restoring the viscosity of the broken fluid include restoration of pH, heating or cooling the system to the point at which viscoelasticity is restored.

In one embodiment, the viscosity of the fluid is broken by contacting the thickened fluid with an effective amount of hydrocarbon or substituted hydrocarbon.

Other breakers known in the art may be suitably employed. For example, U.S. Published Application No. 2008/0070813 A1 discloses oxidizers as internal breakers for viscoelastic surfactant fluids and free radical propagating agents, for example reducing sugars, and reducing di-, tri-, oligo- and poly-saccharides as accelerators for the oxidizers. U.S. Published Application No. 2008/0070806 A1 discloses the use of aldehydes as internal breakers for viscoelastic surfactant fluids and as breaker aides for oxidizers used as internal breakers. Two of the aldehydes disclosed were glutaraldehyde and glucose.

Simple monoalcohols and glycols have also been used in viscoelastic surfactant fluids as breakers and as stabilizers (depending upon the exact choices of monoalcohol or glycol, surfactant, concentrations and conditions) (see for example, U.S. Published Application Nos. 2003/0119680 A1, 2002/0004464 A1, 2002/0193257 A1, 2007/244015 A1, and U.S. Pat. No. 6,929,070 B2). Glycols, especially glycol ethers, especially high molecular weight polyglycol ethers, have been used in viscoelastic surfactant fluids as rheology enhancers (see for example U.S. Published Application No. 2006/0185842 A1 and U.S. Pat. No. 7,341,980 B2). Polyols are known to break linear or cross-linked polymer-based viscosified fluids (see U.S. Published Application No. 2007/0072776 A1). Aldehydes, including sugar aldehydes can be breakers for viscoelastic surfactant fluids and breaker aides for oxidizing agents used as breakers for viscoelastic surfactant fluids (see U.S. Published Application No. 2008/0070806 A1).

U.S. Published Application No. 2008/0269081 A1 discloses polyols in general, including glycerols, aldehydes and ketones and sugars that are polyols, alone or in combination with monoalcohols, as breakers for viscoelastic surfactant fluids and breaker aides for oxidizing agents used as breakers for viscoelastic surfactant fluids. This application discloses that these polyol systems are particularly suitable as internal breakers for viscoelastic surfactant based fluids and as breaker aides to accelerate the action of oxidizers used as internal breakers. U.S. Published Application No. 2008/0269081 A1, which can be consulted for additional details regarding viscoelastic surfactants and breakers, and the disclosure of which relating to viscoelastic surfactants and breakers is incorporated herein by reference.

In one embodiment, the breaker comprises a metal ion having at lest two oxidation states, one of which interferes with the ability of the viscoelastic surfactant to form a viscosifying micelle and a redox agent that is capable of changing the oxidation state of the metal ion to the oxidation state which interferes with the ability of the viscoelastic surfactant to form a viscosifying micelle, as disclosed in U.S. Published Application No. 2007/0060482 A1. As disclosed therein, the metal ion may be iron, zinc, tin chromium or any combination of suitable metal ions. Each of these metal ions has two oxidation states, and for example, the $Fe^{+3}$ oxidation state of iron and the $Cr^{+3}$ oxidation state of chromium are disclosed as interfering with the ability of the viscoelastic surfactant to form a viscosifying micelle, while the $Fe^{+2}$ and $Cr^{+6}$ oxidation states do not so interfere. Exemplary redox agents include both reducing agents and oxidizing agents, and may include, e.g., thioglycolic acid (or a salt thereof), erythorbic acid (or a salt thereof), and stannous chloride. Fe-5ATM iron control agent and Fe-8MTM iron control agent, available from Halliburton Energy Services, Inc., Duncan, Okla., are examples of commercially-available reducing agents. Examples of suitable oxidizing agents include, but are not limited to, sodium persulfate, potassium persulfate, ammonium persulfate, potassium permanganate, sodium permanganate, sodium perborate, potassium perborate, sodium periodate, potassium periodate, sodium bromate and lithium hypochlorite. Examples of commercially-available oxidizing agents include SP™ Breaker agent available from Halliburton Energy Services, Inc, Duncan, Okla., OXOL™ II Cleaning service available from Halliburton Energy Services, Inc, Duncan, Okla., and GBW-40™ Breaker available from Halliburton Energy Services, Inc, Duncan, Okla.

The foregoing U.S. Published Applications and Patents relating generally to breakers can be consulted for additional details regarding both breakers and viscoelastic surfactants, and the disclosure of each of which relating to both breakers and viscoelastic surfactants is incorporated herein by reference.

Control of Onset of Viscoelastic Surfactant Activity

In one embodiment, the present invention further includes methods for controlling the onset of the pseudosolid elastic behavior when the viscoelastic surfactant is present at a suitable concentration in the fluid. This may be accomplished, for example by controlling the concentration of certain partially charged sites within the composition, as disclosed in U.S. Pat. No. 6,232,274. As disclosed therein, the term "partially charged sites" includes groups, molecules, or atoms, whether or not attached to larger molecules, of polar or ionic character. The concentration of the partially charged sites is used as a means to control or delay the onset of gelation (i.e., the pseudosolid elastic behavior) in viscoelastic surfactant based viscoelastic fluids after the fluid has been mixed. The control can be achieved by at least three different mechanisms:

the delayed release of a specific counter-ion such as the formation of the salicylate anion by ester hydrolysis;

the controlled removal of a hydrogen bonding modifier such as urea or guanidine hydrochloride in surfactant systems where hydrogen bonding provides a significant interaction between the entangled micelles; or the controlled change in the ionic composition of the surfactant solution.

In one embodiment, by the first method, the onset of pseudosolid elastic behavior can be delayed or advanced by the controlled release of the counter-ion into the surfactant solution. For example, an aqueous solution of the viscoelastic surfactant cetyltrimethylammonium bromide (CTAB) will immediately form a viscoelastic fluid in the presence of the salicylate anion but not with salicylic acid or derivatives of salicylic acid such as an ester or an amide. The salicylate anion can be released from derivatives by acid or alkaline hydrolysis.

In another embodiment, by the second method, the onset of pseudosolid elastic behavior can be delayed or advanced by control of hydrogen bonding between the entangled worm-like micelles. It has been observed that some surfactants such as N-erucyl-N,N-bis(2-hydroxyethyl)-N-methylammonium chloride do not require the presence of a large organic anion such as salicylate to form viscoelastic solutions. At ambient temperature N-erucyl-N,N-bis(2-hydroxyethyl)-N-methylammonium chloride forms a viscoelastic solution when the concentration of a suitable electrolyte is in excess of about 0.5 weight percent. The addition of hydrogen bonding modifiers such as urea, guanidine hydrochloride and urethane do inhibit viscoelasticity, and these can be broken down, e.g., by base or acid hydrolysis, thereby allowing the hydrogen bonding to occur and thereby the viscoelastic fluid to exhibit the pseudosolid elastic behavior.

In another embodiment, in the third method, the onset of pseudosolid elastic behavior can be delayed or advanced by exploiting the sensitivity of viscoelastic behavior to the ionic environment of the solution. One method of triggering the onset of the behavior is by formulating it with a low electrolyte concentration and then subsequently adding electrolyte to achieve the required viscosity. A second example of this variant involves the exchange of a salt which inhibits the pseudosolid elastic behavior with one which promotes such behavior. For example, solutions of the surfactant N-erucyl-N,N-bis(2-hydroxyethyl)-N-methylammonium chloride will not gel in the presence of electrolytes containing carbonate, iodide, hydroxide or acetate ions but will form gels in the presence of electrolytes containing chloride, bromide, sulphate and nitrate ions. One method for carrying out the exchange is to add ions such as chloride, to initiate the gelation. As used in the foregoing, "gelation" refers to the onset of the pseudosolid elastic behavior in the fluid comprising the viscoelastic surfactant.

It is noted that, throughout the specification and claims, the numerical limits of the disclosed ranges and ratios may be combined, and are deemed to include all intervening values. In the summary and this detailed description, each numerical value should be read once as modified by the term "about" (unless already expressly so modified), and then read again as not so modified, unless otherwise indicated in context.

While the principles of the invention have been explained in relation to certain particular embodiments, and are provided for purposes of illustration. It is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the claims.

The invention claimed is:

1. A ballistic armor system adapted to protect against penetration of the armor system by projectiles, comprising:

a first armor layer;

a second armor layer, wherein the second armor layer is mounted in spaced-apart relationship to the first armor layer, the relationship defining a void volume between the first armor layer and the second armor layer; and a fluid disposed in the void volume, wherein the fluid comprises a viscoelastic surfactant at a concentration sufficient to exhibit pseudosolid elastic behavior.

2. The ballistic armor system of claim 1 wherein the fluid comprising the viscoelastic surfactant provides improved protection against penetration of the armor system by projectiles relative to the system with air or a non-viscous fluid disposed in and substantially filling the void volume.

3. The ballistic armor system of claim 1 further comprising structural contact points disposed in contact with the first armor layer and the second armor layer adapted to maintain the layers in the spaced apart relationship.

4. The ballistic armor system of claim 1 further comprising a fluid-tight seal at or near at least of portion of outer edges of the first armor layer and the second armor layer to retain the fluid in the void volume.

5. The ballistic armor system of claim 1 wherein the first armor layer and the second armor layer each comprise properties of hardness, thickness, fracture toughness, impact resistance, tensile strength, corrosion resistance and weldability, and wherein one or more of the properties are different between the first armor layer and the second armor layer but are complementary in providing protection against penetration of the armor system by projectiles.

6. The ballistic armor system of claim 1 wherein the first armor layer and the second armor layer are in substantially parallel planar spaced-apart relationship.

7. The ballistic armor system of claim 1 further comprising a frangible structure adapted to release a portion of the fluid from the void volume when internal pressure within the void volume increases to a predetermined level.

8. The ballistic armor system of claim 7 wherein the internal pressure increase occurs as a result of impact of a projectile against an outer surface the armor system.

9. The ballistic armor system of claim 7 wherein the predetermined level is substantially greater than a pressure level reached as a result of normal environmental temperature or pressure changes.

10. The ballistic armor system of claim 1 wherein the void volume further comprises a volume of air or gas in addition to the fluid.

11. The ballistic armor system of claim 10 wherein the volume of air or gas is in a range up to about 50% by volume of the void volume.

12. The ballistic armor system of claim 10 wherein the volume of air or gas is dispersed in the fluid directly or enclosed in a bead.

13. A method for improving protection from projectile impact in a ballistic armor system, comprising:

providing a ballistic armor system, comprising:

a first armor layer;

a second armor layer, wherein the second armor layer is mounted in spaced-apart relationship to the first armor layer, the relationship defining a void volume between the first armor layer and the second armor layer; and adding to the void volume a fluid comprising a viscoelastic surfactant at a concentration sufficient to exhibit pseudosolid elastic behavior.

14. The method of claim 13 wherein the fluid comprising the viscoelastic surfactant provides improved protection against penetration of the armor system by projectiles relative to the system with air or a non-viscous fluid disposed in and substantially filling the void volume.

15. The method of claim 13 further comprising structural contact points disposed in contact with the first armor layer and the second armor layer adapted to maintain the layers in the spaced apart relationship.

16. The method of claim 13 further comprising a fluid-tight seal at or near at least of portion of outer edges of the first armor layer and the second armor layer to retain the fluid in the void volume.

17. The method of claim 13 wherein the first armor layer and the second armor layer each comprise properties of hardness, thickness, fracture toughness, impact resistance, tensile strength, corrosion resistance and weldability, and wherein one or more of the properties are different between the first armor layer and the second armor layer but are complementary in providing protection against penetration of the armor system by projectiles.

18. The method of claim 13 wherein the first armor layer and the second armor layer are in substantially parallel planar spaced-apart relationship.

19. The method of claim 13 further comprising a frangible structure adapted to release a portion of the fluid from the void volume when internal pressure within the void volume increases to a predetermined level.

20. The method of claim 19 wherein the internal pressure increase occurs as a result of impact of a projectile against an outer surface the armor system.

21. The method of claim 19 wherein the predetermined level is substantially greater than levels reached as a result of normal environmental temperature or pressure changes.

22. The method of claim 13 further comprising adding to the fluid a breaker to terminate the pseudosolid elastic behavior and to cause a substantial decrease in viscosity of the fluid; and removing the fluid from the volume.

* * * * *